United States Patent [19]

Smith

[11] 4,168,412

[45] Sep. 18, 1979

[54] ELECTRICAL SWITCH CONSTRUCTION AND METHOD OF MAKING THE SAME

[75] Inventor: William N. Smith, Knoxville, Tenn.

[73] Assignee: Robertshaw Controls Company, Richmond, Va.

[21] Appl. No.: 897,737

[22] Filed: Apr. 19, 1978

[51] Int. Cl.[2] ..... H01H 5/18

[52] U.S. Cl. ..... 200/67 D; 200/67 DA

[58] Field of Search ..... 200/67 D, 67 E, 67 DA, 200/288, 154, 153 V

[56] References Cited

U.S. PATENT DOCUMENTS

| | | | |
|---|---|---|---|
| 2,330,506 | 9/1943 | Matthias | 200/67 D |
| 2,428,172 | 9/1947 | Miller | 200/67 D |
| 2,897,308 | 7/1959 | Ferfus | 200/67 D |

FOREIGN PATENT DOCUMENTS

| | | | |
|---|---|---|---|
| 297157 | 9/1928 | United Kingdom | 200/288 |

*Primary Examiner*—Harry N. Haroian

*Attorney, Agent, or Firm*—Candor, Candor & Tassone

[57] ABSTRACT

An electrical switch construction having a fixed contact and a movable switch blade carrying a contact for cooperating with the fixed contact under the control of an actuator spring that sustains a contact force on the closed contacts until the actuator spring is snapped overcenter by a movable actuator member operatively associated with the actuator spring, the construction having a stop normally spaced from the actuator spring and adapted for only being engaged by the actuator spring and thereby limiting movement of the actuator spring caused by normal actuation movement of the actuator member when the actuator spring is snapped in one direction by the actuator member to close the contacts. The stop comprises a biasing means. A fixed non-current carrying stop is also provided to be engaged by the blade when the blade is moved by the actuator spring in the contact closing direction and another biasing means carries the fixed contact for being biased in the contact closing direction under the force of the actuator spring placing the blade against the stop and the contact thereof into contact with the fixed contact.

24 Claims, 6 Drawing Figures

ELECTRICAL SWITCH CONSTRUCTION AND METHOD OF MAKING THE SAME

BACKGROUND OF THE INVENTION

1. Field of the Invention

This invention relates to an electrical switch construction of the sustained contact force type and to a method of making such an electrical switch construction or the like.

2. Prior Art Statement

It is known to provide an electrical switch construction having a fixed contact and a movable switch blade carrying a contact for cooperating with the fixed contact under the control of an actuator spring that sustains a contact force on the closed contacts until the actuator spring is snapped overcenter by a movable actuator member operatively associated with the actuator spring.

For example, see the following four items:

(1) U.S. Pat. No. 4,109,121—Bauer et al (2) U.S. Pat. No. 3,967,086—Bauer (3) U.S. Pat. No. 2,821,588—Fisher (4) U.S. Pat. No. 2,428,172—Miller It appears that the housing for the electrical switch construction of item (1) above has fixed stops against which the actuator spring engages to limit movement thereof through its movement relative to the actuator member which has lost motion means operatively interconnecting the actuating member to the actuator spring to permit such relative movement.

It appears that no stops are provided for the actuator spring of the electrical switch construction of item (2) above, but that fixed stops are provided for the tail portion of a toggle member carrying the actuator spring.

It appears that no stops are provided for limiting the movement of the actuator spring of the electrical switch construction of item (3) above except for tangs carried by the switch blade.

It appears that a coiled compression spring is always in engagement with the actuator spring of the electrical swich construction of Item (4) above and limits movement of the actuator spring in on direction thereof.

It also appears that the movable contact carried by the switch blade of each of the electrical switch construction of the above three items, (1), (2), (3) and (4), engages against a rigidly fixed contact.

However, it is known to provide a srping loaded contact for a fixed contact together with a rigid stop for limiting movement of the switch blade carrying a contact that engages the fixed contact in a spring loaded direction thereof.

For example, see the following two items:

(5) British Pat. No. 995,933—Polycontact A. G.

(6) U.S. Pat. No. 2,897,308—Fergus

It appears that the electrical switch construction of each item (5) and (6) above has the rigid stop formed of electrically conductive material to provide a current carrying function.

SUMMARY OF THE INVENTION

It is a feature of this invention to provide improvements for electrical switch constructions that sustain a predictable amount of contact force before contact transfer.

In particular, it has been found that it would be desirable to utilize such a sustained contact force electrical switch construction in an applicaton with extremely close tolerances and to perform through thousands of cycles with little or no drift. One part of the drift of such a switch construction results from mechanical wear of the switch members and the other contribution to drift is from erosion of contact material from electrical cycling and, therefore, to meet extremely close tolerances, both of these drift factors must be minimized.

Mechanical wear in electrical switch constructions causes positional changes in the point of contact transfer whether from a normally closed position to a normally open position or from a normally open position to a normally closed position. It is known that the percent change from the initial callibration of such switch constructions can be reduced by increasing the differential travel and this is accomplished in the switch construction of the aforementioned copending patent application Ser. No. 707,635, by increasing the lost motion distance in the actuator member and adding fixed stops to control the travel of the actuator spring through such lost motion.

In particular, with the use of such fixed stops, such an electrical switch construction, for example, can have a differential travel of as high as 0.075 of an inch but only see the mechanical wear created by 0.007 of an inch. However, even though this would greatly reduce the percent of drift on a control utilizing an electrical switch of this kind, overtravel would be significantly reduced because of the actuator spring stop positions whereby this reduced overtravel places a negative limitation upon the application of such electrical switch constructions to many controls.

Accordingly, it is a feature of this invention to provide a stop for the actuator spring of such an electrical switch construction or the like that comprises a biasing means in order to gain the desired overtravel.

In particular, one embodiment of this invention provides an electrical switch construction having a fixed contact and a movable switch blade carrying a contact for cooperating with the fixed contact under the control of an actuator spring that sustains a contact force on the closed contact until the actuator spring is snapped overcenter by a movable actuator member operatively associated with the actuator spring, the construction having a biasing means providing a stop normally spaced from the actuator spring and adapted for only being engaged by the actuator spring and thereby limiting movement of the actuator spring caused by normal actuation movement of the actuator member when the actuator spring is snapped in one direction by the actuator member to close the contacts. The biasing means, thereafter, is biased under the force of the actuator member further moving the actuator spring in the one direction so as to allow for overtravel.

As to the aforementioned contact erosion factor that contributes to switch wear, this feature is extremely critical when working with DC loads.

In particular, the material transfer from stationary to moving contact (or vise versa) is much greater with a current of constant polarity and the position at which the two contacts touch each other directly effects the point of switching of most sustained contact force switch constructions. Thus, as this point changes due to material erosion of the contacts, so does the switch constructions's callibration change.

However, it was found according to the teachings of this invention that by making the point which determines the point of switching a non-current carrying surface, drift due to contact erosion in a sustained contact force switch construction can be substantially eliminated.

It was also found that this feature can be accomplished in an electrical switch construction that sustains contact force up to the switching point by utilizing some of this contact force to keep the switch blade in contact with an insulated stop while the rest of the force is used to bias a biasing means carrying the stationary contact.

In this manner, the force of the biasing means is what determines the amount of contact force between the moving and stationary contacts and as contact erosion occurs, the biasing means gives. While this reduces the contact force slightly, the switch constructions's "trip point,38 that is determined by the insulated stop, remains constant.

Therefore, another embodiment of this invention provides an electrical switch construction having a first contact and a movable switch blade carrying a second contact for cooperating with the first contact under the control of an actuator spring that sustains a contact force on the closed contacts until the actuator spring is snapped overcenter by a movable actuator member operatively associated with the actuator spring. A fixed non-current carrying stop is carried by the construction to be engaged by the switch blade when the switch blade is moved by the actuator spring in the contact closing direction for placing the second contact into contact with the first contact. A biasing means carries the first contact for being biased in the contact closing direction under the force of the actuator spring placing the blade against the stop and the second contact into contact with the first contact.

Accordingly, it is an object of this invention to provide an improved electrical switch construction having one or more of the novel features of this invention as set forth above or hereinafter shown or described.

Another object of this invention is to provide an improved method of making such an electrical switch construction or the like, the method of this invention having one or more of the novel features of this invention as set forth above or hereinafter shown or described.

Other objects, uses, and advantages of this invention are apparent from a reading of this description which proceeds with reference to the accompanying drawings forming a part thereof and wherein.

DESCRIPTION OF THE PREFERRED EMBODIMENTS

Figure 1:
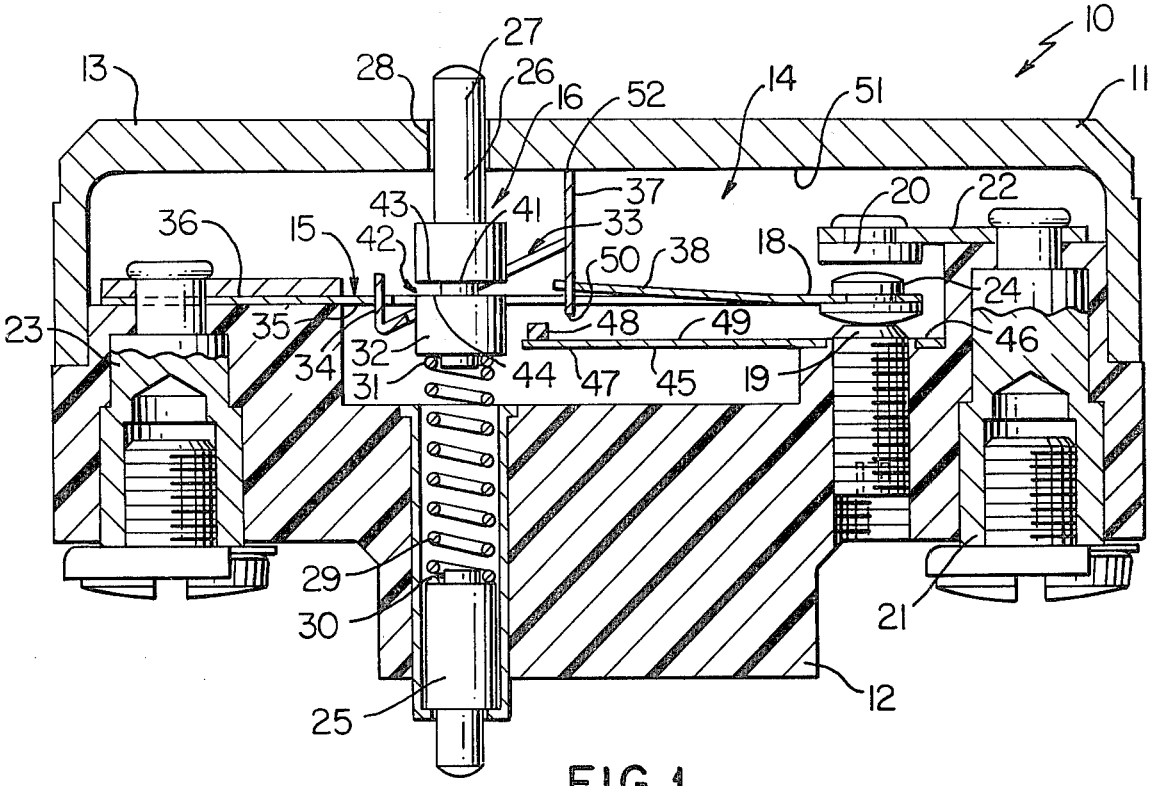
FIG. 1 is a cross-sectional view illustrating one embodiment of the electrical switch construction of this invention.
Figure 2:
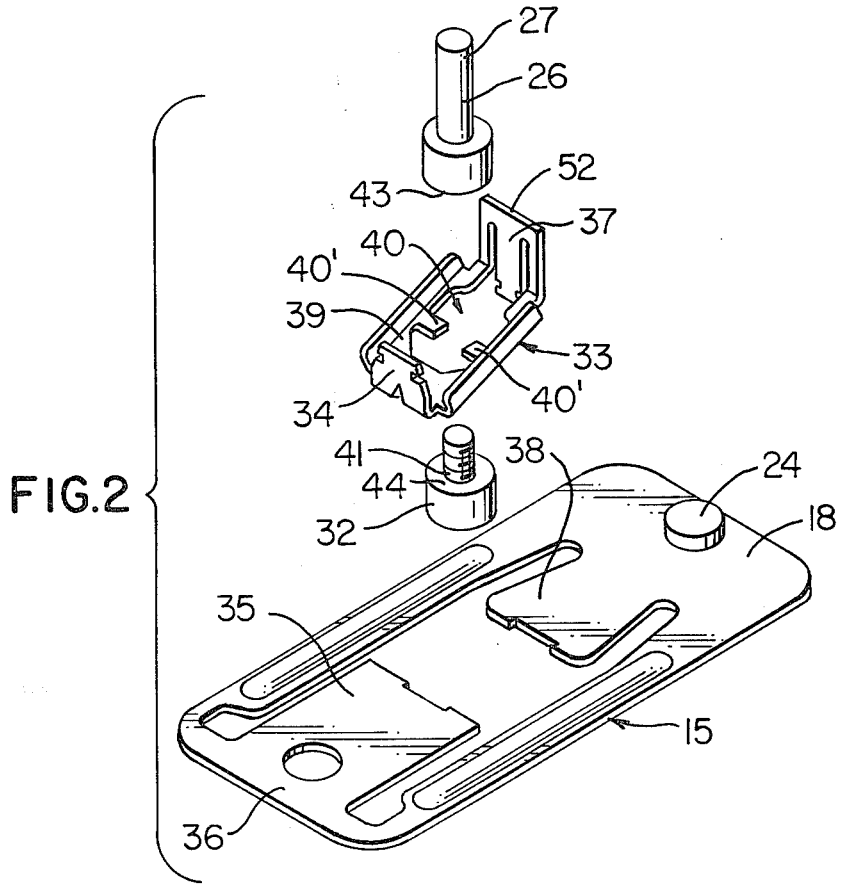
FIG. 2 is an exploded perspective view of the actuator member, actuator spring and switch blade of the switch construction of FIG. 1.

While the various features of this invention are hereinafter described and illustrated as being particularly adapted to provide a single throw application, it is to be understood that the various features of this invention can be utilized singly or in any combination thereof to provide electrical switch construction of a double throw type, if desired.

Therefore, this invention is not to be limited to only the embodiments illustrated in the drawings, because the drawings are merely utilized to illustrate one of the wide variety of uses of this invention.

Referring now to FIGS. 1–4, one embodiment of the electrical switch construction of this invention is generally indicated by the reference numeral 10 and comprises a housing means 11 formed from a first housing part 12 cooperating with a cover housing part 13 to define a chamber 14 therein containing a snap switch blade 15 adapted to be operated by an actuator means that is generally indicated by the reference numeral 16 to switch a contact carrying portion 18 of the switch blade 15 between a pair of spaced stops 19 and 20 with the stop 19 being a threaded adjusting member and the stop 20 being a contact means electrically interconnected to external terminal means 21 by a rigid conductive member 22, the switch blade 15 being pivotally mounted to the housing means 11 by its terminal means 23 that is also external to the housing means 11.

Figure 3:
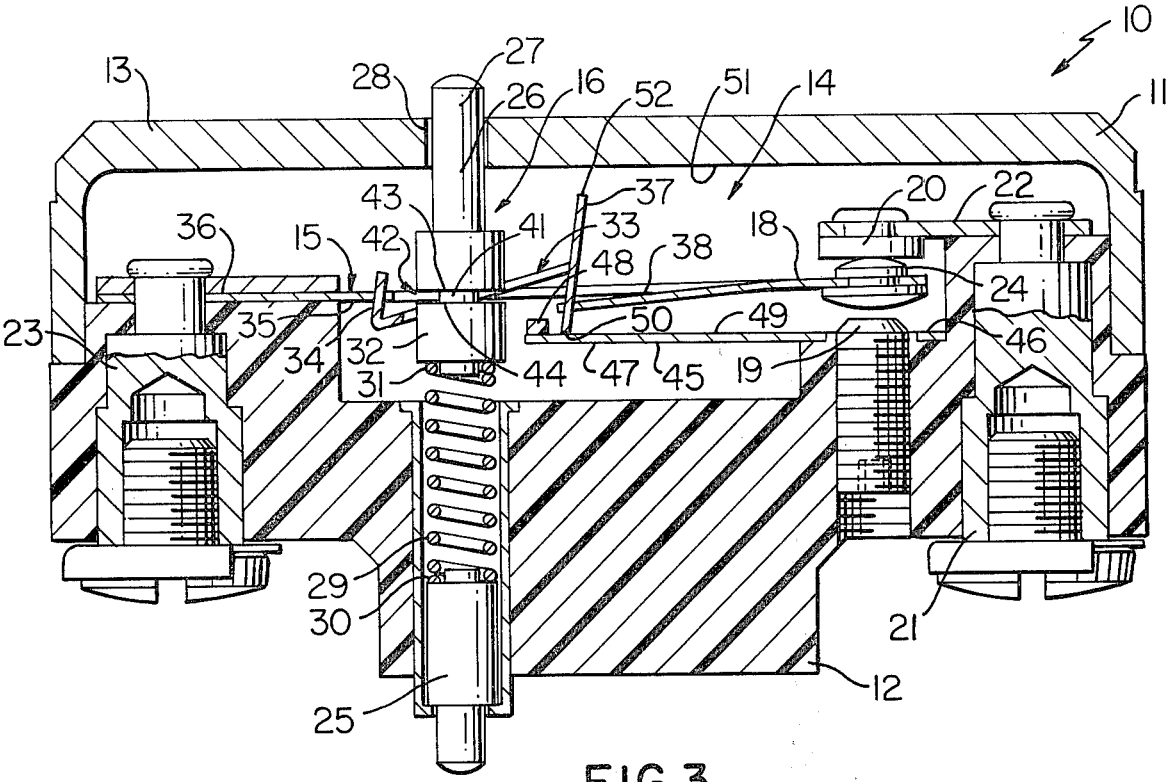
FIG. 3 is a view similar to FIG. 1 and illustrates the switch construction in another operating condition thereof.
Figure 4:
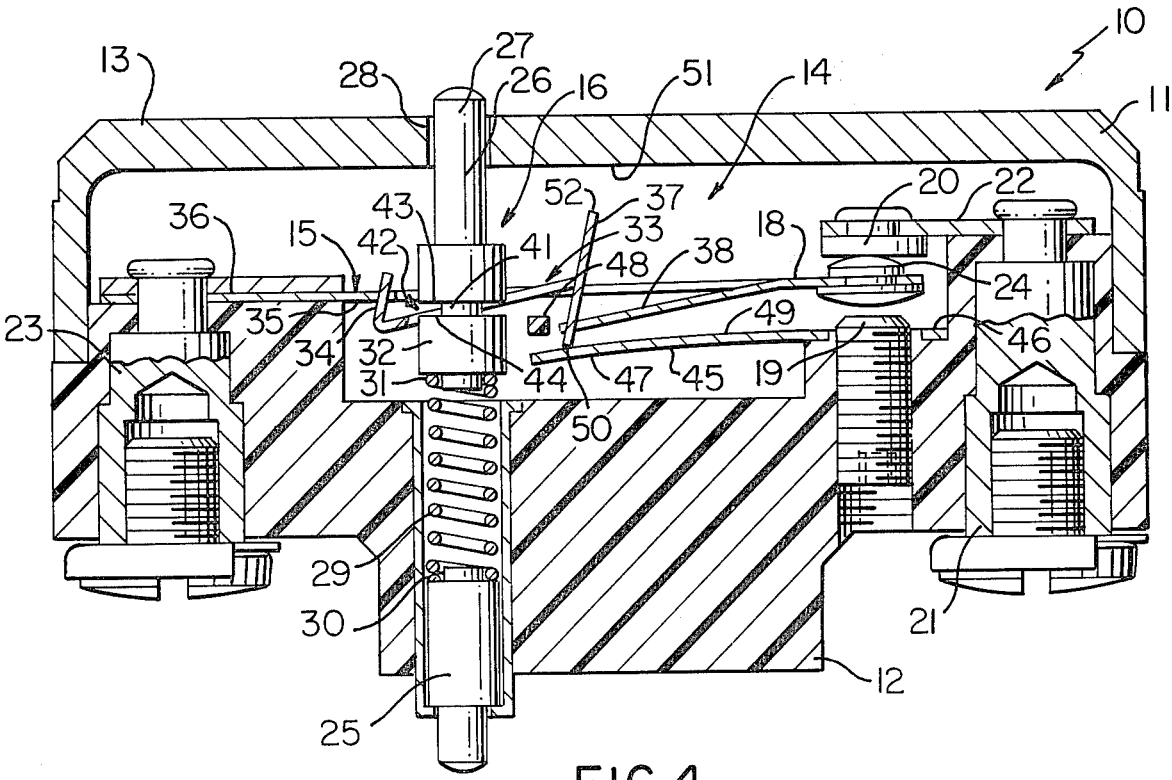
FIG. 4 is a view similar to FIG. 3 and illustrates the switch construction in an overtravel condition thereof.

In this manner, the terminal 23 is adapted to be electrically interconnected to the terminal 21 of the switch construction 10 when the switch blade portion 18 has its contact means 24 disposed in electrical contact with the upper contact 20 in the manner illustrated in FIGS. 3 and 4. However, when the actuator means 16 is moved in a manner hereinafter described to the position illustrated in FIG. 1, the switch blade 15 is snapped from the upper contact 20 to the lower stop 19 so that the terminal 23 is disconnected from the terminal 21 for any desired control purpose.

The actuator means 16 includes an actuator button or plunger 26 that has a part 27 projecting out of an opening 28 in the cover 13 and being urged to its out position by a return compression spring 29 having one end 30 bearing against a movable reset plunger 25 and the other end 31 bearing against a lower part 32 of the plunger 26 whereby in order to switch the switch blade 15 from the condition illustrated in FIG. 3 back to the condition illustrated in FIG. 1, the plunger 25 must be moved inwardly relative to the housing means 11 to compress the compression spring 29 and cause the increased force of the compression spring 29 to urge the plunger 26 upwardly to switch the switch blade 15 from the condition illustrated in FIG. 3 to the condition illustrated in FIG. 1 as will be apparent hereinafter.

The actuator means 16 also includes an actuator spring 33 that has one leg 34 pivoted to part 35 of a rear portion 36 of the blade 15 and another leg 37 interconnected to a tongue part 38 of the forward portion 18 of the blade 15 as will be apparent hereinafter, the legs 34 and 37 of the actuator spring 33 being compressed towards each other when assembled with the blade 15 into the arrangement illustrated in FIG. 1 for a purpose hereinafter described.

An intermediate central part 39 of the actuator spring 33 has an opening 40 passing therethrough and receiving a reduced portion 41 of the actuator plunger 36 therethrough whereby the intermediate part 39 of the actuator spring 33 is disposed in the lost motion means or air gap 42 of the actuator plunger 26 that is defined between a pair of opposed shoulders 43 and 44 thereof. In this manner, the actuator spring 33 can move relative to the plunger 26 as will be apparent hereinafter, the opening 40 through the central portion 39 of the actuator spring 33 defining a pair of inwardly directed tongues or tangs 40' that are received between the shoulders 43 and 44 of the actuator plunger 16 to be engaged respectively thereby as will be apparent hereinafter.

The switch construction 10, as previously described, is substantially identical in construction and operation to the electrical switch constructions described and claimed in the aforementioned copending patent application, Ser. No. 707,635, as well as the feature of providing a sustained contact force of the contact means 24 against the stop 19 (whether a stop or a contact) until the actuator spring 33 is moved overcenter by the plunger 26 being moved downwardly in FIG. 1 to snap the blade portion 18 upwardly to place the contact 24 into contact with the upper fixed contact 20 as illustrated in FIG. 3. Conversely, upon the actuation of the reset plunger 25 upwardly into the housing means 11, the plunger means 26 is moved upwardly to again move the actuator spring 33 overcenter, the blade 15 sustaining a contact force against the closed contacts 24 and 20 until the actuator member 33 moves overcenter to snap the blade portion 18 downwardy and move the contact 24 against stop 19 as illustrated in FIG. 1.

In particular, when the actuator spring 33 is being moved downwardly about its pivot point by the shoulder 43 of the actuator plunger 26 pushing downwardly on the intermediate tongues 40' of the actuator spring in opposition to the force of the reset spring 29, the point of interconnection of the switch blade tongue 38 and the actuator spring 33 moves downwardly and when the same reaches a certain point, the actuator spring 33 itself snaps overcenter to cause the stored energy in the spring 33 to move the actuator spring 33 rapidly downwardly relative to the actuator plunger 29 through the air gap or lost motion means 42 thereof and when the actuator spring 33 reaches the overcenter position for the switch blade 15, the blade 15 snaps overcenter through the force of the spring 33 whereby the contact portion 18 thereof snaps rapidly upwardly to place the contact 24 against the upper normally open contact 20 as illustrated in FIG. 3. Thus, when the actuator spring 33 reaches the point that the stored energy of the actuator spring 33 takes over to move the same relative to the plunger 26, the actuator spring 33 still must move a certain distance before the switch blade 15 moves overcenter so that the time when the actuator spring 33 reaches the overcenter point for the actuator spring 33, the switch blade 15 is maintaining the contact 24 into contact with the fixed lower stop 19 with a sustained force at this so-called "trip point" of the switch construction 10.

When the actuator plunger 26 is released and the reset plunger 25 is moved inwardlyso that the increased force of the compression spring 29 can move the actuator plunger 26 upwardly from the position illustrated in FIG. 3, the shoulder 44 of the plunger 26 comes into contact with the intermediate parts 40' of the actuator spring 33 and moves the actuator spring 33 upwardly until the same goes overcenter in the opposite direction and snaps upwardly relative to the actuator button 26 through the lost motion means 42 whereby the blade 15 is now moved overcenter so that the blade 15 snaps from the up position of FIG. 3 back to the down position illustrated in FIG. 1. Thus, it can be seen that a contact force is being sustained at the upper contact 20 at the time the actuator spring 33 goes overcenter which is the "trip point" of the switch construction 10.

In this manner, it can be seen that the distance of the air gap between the shoulders 43 and 44 of the actuator plunger 26 determines the movement differential of the actuator means 16 for causing the switch blade 15 to move between the spaced contact stops 19 and 20.

Therefore, by merely making the part 41 of the actuator plunger 26 with external threads and threading the same into a threaded bore formed at the upper part 27 of the actuator plunger 26, the air gap or lost motion means 42 can be adjusted to have the shoulders 43 and 44 moved apart a desired distance so that the movement differential of the switch construction 10 can be adjusted without causing any change in the contact forces being sustained at the respective contacts 19 and 20.

As previously stated, with a relatively large air gap 42 in the actuator plunger 26, the movement of the actuator spring 33 beyond the snap point of the switch blade 15 can be controlled by providing stops in the chamber 14 to limit the up and down movement of the actuator spring 33 through the lost motion means 42 beyond the overcenter points of the main blade 15 as fully set forth in the aforementioned copending patent application, Ser. No. 701,635.

However, even though this greatly reduces the percent drift of a control utilizing such a switch construction 10, overtravel would be significantly reduced because of the actuator spring stop positions. This reduced overtravel puts a negative limitation upon the application of such a switch construction to many different controls.

Therefore, it is a feature of this invention to provide at least one stop for the actuator spring 33 that will still provide for the desired overtravel.

In particular, a leaf-like spring member 45 has one end 46 thereof fastened to the housing part 12 while the other end 47 thereof is biased against a fixed stop 48 of the housing means 11 whereby the natural bias force of the flexure or biasing means 45 is to maintain the end 47 thereof into contact with the stop 48 with a certain preloaded and predetermined force as will be apparent hereinafter.

The position of the stop 48 is so located that the upper surface 49 of the flexure 45 will be engaged by the end 50 of the leg 37 of the actuator springs 33 when the actuator spring 33 has been moved overcenter by the downwardly moving plunger 26 to cause the actuator spring 33 to move partly through the lost motion means 42 and snap the switch blade portion 18 upwardly to place the contact 24 into contact with its upper contact 20 as previously described. Thus, the end 50 of the leg 37 of the actuator spring 33 merely abuts against the biasing means 45 without biasing the same in the manner illustrated in FIG. 3 when the plunger 26 has been moved a normal distance to cause the switching condition of FIG. 3.

However, if the control that is operating on the plunger 26 further moves the plunger 26 downwardly so that the shoulder 43 thereof again engages the tangs 40' of the actuator spring 33 to move the actuator spring 33 further downwardly in opposition to the force of the compression spring 29, the blade 45 flexes downwardly therewith as illustrated in FIG. 4 so that undue loading upon the actuator spring 33 and other parts of the switch construction 10 will not be provided as would be the case if the actuator spring 33 merely abutted against a fixed stop as taught in the aforementioned copending patent application, Ser. No. 707,635.

For example, the under surface 51 of the cover member 13 is being utilized as an upper fixed stop for the upper end 52 of the leg 37 of the actuator spring 33 when the same is being moved upwardly by the reset plunger 25.

Of course, another flexible stop 45 can be provided for the upper end 52 of the actuator spring 33 according to the teachings of this invention, if desired.

Thus, it can be seen that by preloading the flexure member or biasing means 45 to a force higher than the actuator spring 33 at its point of contact against the flexure member 45 when the actuator plunger 26 and in its lost motion means 42, the flexure member 45 is sufficiently strong to act as a stop. However, if additional travel of the actuator plunger 26 is needed, the flexure member 45 will stroke under additional load and thereby protect all switch members from extremely high stresses. Also, since this flexible stop 45 governs the contact force of the movable contact 24 against the stationary contact 20, the member 45 acts as a shock absorber for the switch blade 15 and therefore for the contacts 24 and 20. This feature tends to reduce contact bounce which can be extremely detrimental to switch construction performance.

In one example of the switch construction 10, a preload of approximately 300 grams (approximately 100 grams greater than the actuator spring 33) with a spring rate of apprximately 15 lbs. per inch was utilized for the flexure member 45 and this preload and rate provided good contact force limiting along with the desired damping of contact bounce. However, it is to be understood that this invention is not to be limited to any particular spring rates as the same is merely given by way of example.

The operation of the switch construction 10 utilizing the flexible stop 45 will not be described.

With the switch construction 10 in the condition illustrated in FIG. 1 and a suitable control operating on the plunger 26 to move the same downwardly, the shoulder 45 of the plunger 26 acts downwardly on the tongues 40′ of the actuator spring 33 to move the actuator spring 33 overcenter and thereby cause the same to snap the switch blade 15 upwardly to place the contact 24 into contact with the upper contact 20 as illustrated in FIG. 3.

However, when the actuator spring 33 snaps overcenter, the actuator spring 33 moves under its own control through the air gap 42 of the plunger 26 until the end 50 of the leg 37 engages against the upper surface 49 of the leaf spring 45 as illustrated in FIG. 3, which happens after the switch blade 15 has been moved upwardly, and since the force of the preload of the leaf spring 49 against the fixed stop 48 is greater than the force of the spring 33 tending to move further downwardly under its own spring rate, the flexure member 45 acts as a fixed stop as illustrated in FIG. 3.

However, if the control operating on the plunger 26 further moves the plunger 26 downwardly in opposition of the force of the compression spring 29, the shoulder 43 engages against the tangs 40′ of the actuator spring 33 and pivots the same further downwardly as illustrated in FIG. 4 because the member 45 will flex therewith and permit such further downward movement of the actuator spring 33 so that undue forces will not be placed on the actuator spring 33 and other parts of the switch construction 10 as would be the case if the part 45 would not flex in the manner illustrated in FIG. 4.

Should the force on the plunger 26 subsequently be released, the compression spring 25 will move the plunger 26 upwardly to the position illustrated in FIG. 3 and again put the end 47 of the flexure member 45 against the stop 48 so that the actuator spring 33 will remain in the condition illustrated in FIG. 3 until the reset plunger 25 is moved inwardly to snap the blade 15 from the condition illustrated in FIG. 3 back to the condition illustrated in FIG. 1 in the manner previously described.

Therefore, it can be seen that this invention provides an improved electrical switch construction having a biasing stop for the actuator spring thereof as well as provides a method of making such an improved electrical switch construction or the like.

As previously stated, another feature of this invention is to tend to eliminate drift of the electrical switch construction 10 due to contact erosion.

Figure 5:
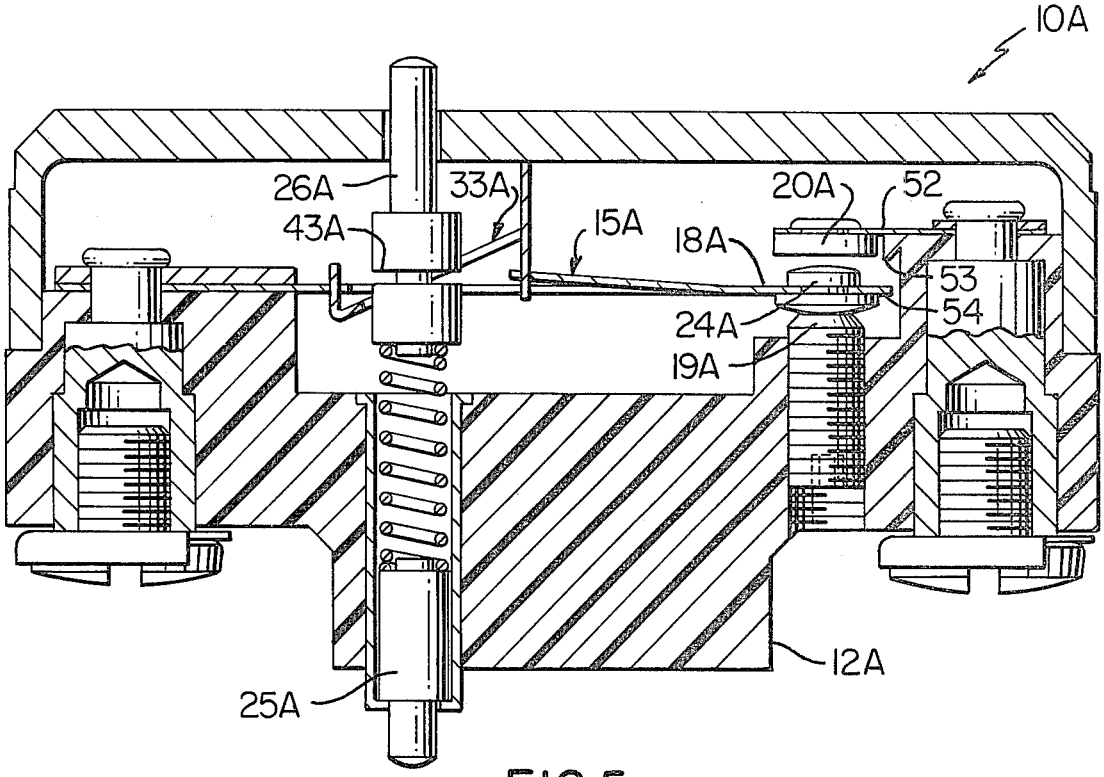
FIG. 5 is a view similar to FIG. 1 and illustrates another embodiment of the electrical switch construction of this invention.
Figure 6:
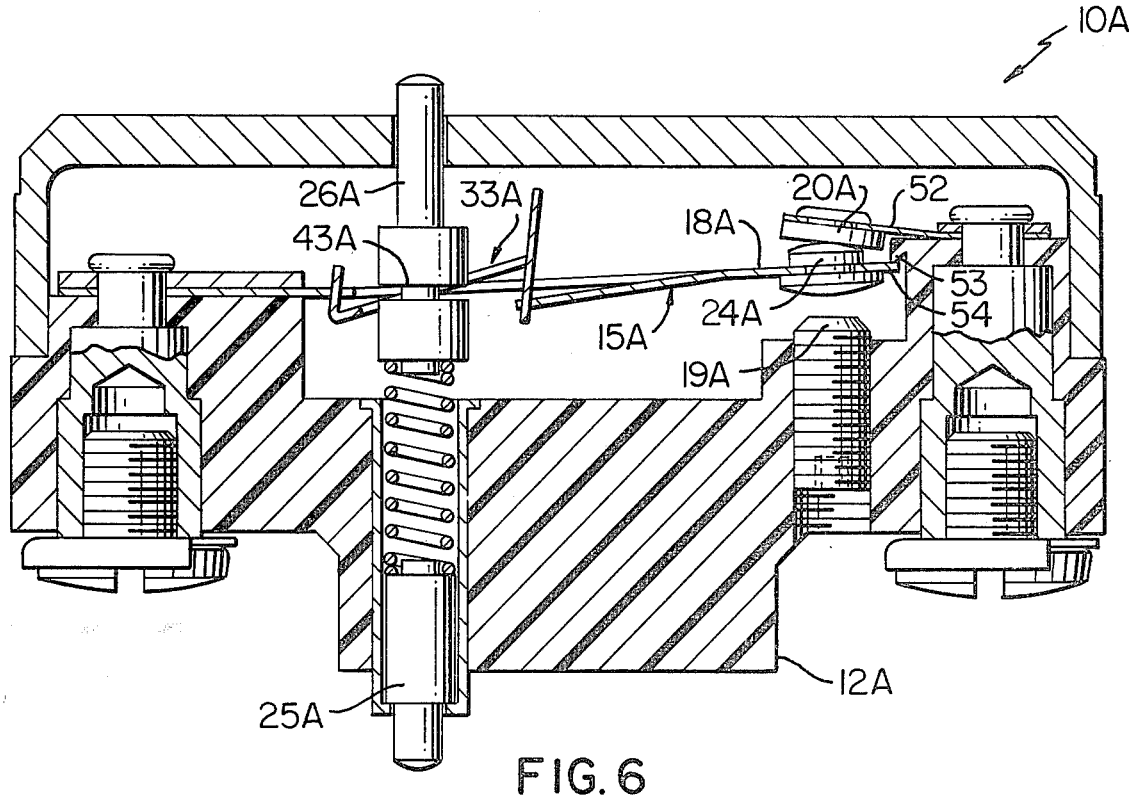
FIG. 6 is a view similar to FIG. 5 and illustrates the switch construction of FIG. 5 in another operating condition thereof.

Accordingly, reference is now made to FIGS. 5 and 6 of the drawings wherein another embodiment of the electrical switch construction of this invention is generally indicated by the reference numeral 10A and parts thereof similar to the switch construction 10 previously described are indicated by like reference numerals followed by the reference "A."

As illustrated in FIGS. 5 and 6, the switch construction 10A is substantially identical to the switch construction 10 previously described except that the flexible stop 45 is not being utilized (although the same could be utilized, if desired) and the relatively rigid connector 22 for the upper contact stop 20 has been replaced by a leaf spring type member 52 and the housing member 12A has been shaped to provide a non-conductive stop 53 disposed in the path of upward movement of the outer free end 54 of the portion 18A of the switch blade 15A for the purpose illustrated in FIG. 6 and now to be described.

It was found according to the teachings of this invention that since the switch construction 10A sustains a contact force up to the switching point thereof in the manner previously described, some of this force can be used to keep the main blade 15A in contact with the insulated stop 53 as illustrated in FIG. 6 (the stop 53 while being illustrated as being fixed, could be made adjustable according to the teachings of this invention). The rest of the sustained contact force is used to bend the flexure 52 which carries the stationary contact 20A in the manner illustrated in FIG. 6. The force of this flexure 52 is what determines the amount of contact force between the moving contact 24A and the stationary contact 20A. As contact erosion occurs between the contacts 24A and 20A, the flexure 52 gives and this reduces the contact force slightly with the switch construction's "trip point," as determined by the insulated stop 53, remaining constant.

Thus, it can be seen that if the switch construction 10A did not sustain enough contact force to deflect the flexure 52 and generate contact force sufficiently high, the moving contact 24A would gradually move away from the insulated stop 53 as the switch construction 10A stroked closer to its "trip point." Contact transfer would occur when the sustained contact force of the switch construction and the flexure force of the flexure 52 would equal. Switch drift would then occur because the switching point would be determined by the current carrying member and that is why it is necessary to have a switch construction that sustains a high amount of contact force for use with the flexure member 52.

In particular, while the sustained contact force switch construction of the aforementioned copending patent application, Ser. No. 707,635, sustained approximately 20% of its full contact force at contact transfer when used as a double throw switch, it can be seen that if the full contact force is 60 grams, that means that 20 grams is sustained and that this is not sufficient for both the bearing force on the insulated stop 53 and the force to bend the contact flexure 52.

However, by positioning the actuator spring 33A so that its pivot is lower than that of the blade 15A (approximately 0.060 of an inch lower), the actuator spring 33A can generate a sustainment of as much as 80% of full contact force on the stationary contact 20A. The other stationary contact 19A (if the switch is double throw) will have no sustained force but can still be used as a normal switch. This arrangement lends itself to all single throw applications. Thus, with 80%, or 50 grams to use, 30 grams can deflect the contact flexure 52 in the manner illustrated in FIG. 6 and the other 20 grams can keep the blade 15A in contact with the insulated stop 53.

The contact flexure 52 also acts as a shock absorber when contact transfer occurs and the flexing or wiping of the contact flexure 52 is also useful for small weld breakage.

The operation of the switch construction 10A will now be described.

With the switch construction 10A in the condition illustrated in FIG. 5, a subsequent downward movement of the plunger 25A causes the shoulder 43A thereof to act on the actuator spring 33A and move the same downwardly in the manner previously described until the actuating spring 33A snaps overcenter to cause the switch blade 15A to move the portion 18A thereof upwardly for the reasons previously set forth.

However, as the end 18A of the switch blade 15A is being snapped upwardly by the actuator spring 33A, the contact 24A first makes contact with the contact 20a and flexes the flexure or biasing means 52 upwardly as illustrated in FIG. 6 until the end 54 of the switch blade 15A engages against the non-conductive stop 53 as illustrated in FIG. 6 whereby the contact 24A is maintained in contact with the contact 20A for a desired electrical switching function.

Subsequently, the upward movement of the plunger 25A resets the switch construction 10A back to the condition illustrated in FIG. 5 in the manner previously described.

Therefore, it can be seen that the use of a flexure 52 and non-conductive stop 53 in the switch construction 10A tends to eliminate drift resulting from erosion of contact material since any contact erosion will be taken up by the amount of flexure of the member 52 as the switch blade 15A will always have its end 54 against the stop 53 to determine the "trip point" when the reset member 25A is utilized to reset the switch blade 15A.

Accordingly, it can be seen that this invention not only provides improved electrical switch contructions, but also this invention provides improved methods of making such electrical switch constructions or the like.

While the forms and methods of this invention now preferred have been illustrated and described as required by the Patent Statute, it is to be understood that other forms and method steps can be utilized and still fall within the scope of the appended claims.

What is claimed is:

1. In an electrical switch construction having a fixed contact and a movable switch blade carrying a contact for cooperating with said fixed contact under the control of an actuator spring that sustains a contact force on the closed contacts until said actuator spring is snapped overcenter by a movable actuator member operatively associated with said actuator spring, said construction having a stop normally spaced from said actuator spring and adapted for only being engaged by said actuator spring and thereby limiting movement of said actuator spring caused by normal actuation movement of said actuator member when said actuator spring is snapped in one direction by said actuator member to close said contacts, the improvement wherein said stop comprises a biasing means.

2. An electrical switch construction as set forth in claim 1 wherein said biasing means has a normal biasing force that prevents biasing thereof when said actuator spring engages the same by its normal movement caused by said normal actuation movement of said actuator member, said biasing means thereafter being biased under the force of said actuator member further moving said actuator spring in said one direction.

3. An electrical switch construction as set forth in claim 2 wherein said biasing means comprises a spring member and a fixed part of said construction, said spring member normally being compressed against said fixed part to provide said normal biasing force thereof.

4. In an electrical switch construction having a fixed contact and a movable switch blade carrying a contact for cooperating with said fixed contact under the control of an actuator spring that sustains a contact force on the closed contacts until said actuator spring is snapped overcenter by a movable actuator member operatively associated with said actuator spring, said construction having a stop normally spaced from said actuator spring and adapted for only being engaged by said actuator spring and thereby limiting movement of said actuator spring caused by normal actuation movement of said actuator member when said actuator spring is snapped in one direction by said actuator member to close said contacts, the improvement wherein said stop comprises a biasing means, said biasing means having a normal biasing force that prevents biasing thereof when said actuator spring engages the same by its normal movement caused by said normal actuation movement of said actuator member, said biasing means thereafter being biased under the force of said actuator member further moving said actuator spring in said one direction, said biasing means comprising a spring member and a fixed part of said construction, said spring member normally being compressed against said fixed part to provide said normal biasing force thereof, said spring member comprising a leaf spring member having opposed ends, one of said ends being fixed to said construction and the other of said ends normally being urged by the natural bias of said leaf spring member into engagement with said fixed part whereby said leaf spring member is provided with said normal biasing force thereof.

5. An electrical switch construction as set forth in claim 4 wherein said actuator spring engages said leaf spring member intermediate said ends thereof.

6. An electrical switch construction as set forth in claim 1 wherein said actuator member has a lost motion means that operatively interconnects said actuator member to said actuator spring.

7. In a method of making an electrical switch construction having a fixed contact and a movable switch blade carrying a contact for cooperating with said fixed contact under the control of an actuator spring that sustains a contact force on the closed contacts until said actuator spring is snapped overcenter by a movable actuator member operatively associated with said actuator spring, said construction having a stop normally spaced from said actuator spring and adapted for only being engaged by said actuator spring and thereby limiting movement of said actuator spring caused by normal actuation movement of said actuator member when said actuator spring is snapped in one direction by said actuator member to close said contacts, the improvement comprising the step of forming said stop from a biasing means.

8. A method of making an electrical switch construction as set forth in claim 7 and including the steps of forming said biasing means to have a normal biasing force that prevents biasing thereof when said actuator spring engages the same by its normal movement caused by said normal actuation movement of said actuator member and causing said biasing means to thereafter bias under the force of said actuator member further moving said actuator spring in said one direction.

9. A method of making an electrical switch construction as set forth in claim 8 and including the steps of forming said biasing means from a spring member and a fixed part of said construction, and compressing said spring member against said fixed part to provide said normal biasing force thereof.

10. In a method of making an electrical switch construction having a fixed contact and a movable switch blade carrying a contact for cooperating with said fixed contact under the control of an actuator spring that sustains a contact force on the closed contacts until said actuator spring is snapped overcenter by a movable actuator member operatively associated with said actuator spring, said construction having a stop normally spaced from said actuator spring and adapted for only being engaged by said actuator spring and thereby limiting movement of said actuator spring caused by normal actuation movement of said actuator member when said actuator spring is snapped in one direction by said actuator member to close said contacts, the improvement comprising the steps of forming said stop from a biasing means, forming said biasing means to have a normal biasing force that prevents biasing thereof when said actuator spring engages the same by its normal movement caused by said normal actuation movement of said actuator member and causing said biasing means to thereafter bias under the force of said actuator member further moving said actuator spring in said one direction, forming said biasing means from a spring member and a fixed part of said construction, compressing said spring member against said fixed part to provide said normal biasing force thereof, forming said spring member from a leaf spring member having opposed ends, fixing one of said ends to said construction, and urging the other of said ends by the natural bias of said leaf spring member into engagement with said fixed part whereby said leaf spring member is provided with said normal biasing force thereof.

11. A method of making an electrical switch construction as set forth in claim 10 and including the step of forming said actuator spring to engage said leaf spring member intermediate said ends thereof.

12. A method of making an electrical switch construction as set forth in claim 7 and including the steps of forming said actuator member with a lost motion means, and operatively interconnecting said actuator member to said actuator spring by said lost motion means.

13. In an electrical switch construction having a first contact and a movable switch blade carrying a second contact for cooperating with said first contact under the control of an actuator spring that sustains a contact force on the closed contacts until said actuator spring is snapped overcenter by a movable actuator member operatively associated with said actuator spring, the improvement comprising a fixed non-current carrying stop carried by said construction to be engaged by said blade when said blade is moved by said actuator spring in the contact closing direction of said second contact with said first contact, a biasing means carrying said first contact for being biased in said direction under the force of said actuator spring placing said blade against said stop and said second contact into contact with said first contact.

14. An electrical switch construction as set forth in claim 13 wherein said fixed non-current carrying stop comprises a non-conductive part of said construction.

15. An electrical switch construction as set forth in claim 13 wherein said biasing means comprises a leaf spring member carrying said first contact.

16. An electrical switch construction as set forth in claim 15 wherein said leaf spring member is a conductive member.

17. An electrical switch construction as set forth in claim 16 wherein said leaf member has opposed ends, one end of said leaf member being fixed to said construction and the other of said ends carrying said first contact, said construction having a second non-current carrying stop, said leaf member having a natural bias placing said leaf against said second stop when said contacts are in an open condition thereof, said second contact flexing said leaf member away from said second stop when said blade is held against its respective stop by said actuator spring.

18. An electrical switch construction as set forth in claim 13 wherein said actuator member has a lost motion means that operatively interconnects said actuator member to said actuator spring.

19. In a method of making an electrical switch construction having a fixed contact and a movable switch blade carrying a second contact for cooperating with said first contact under the control of an actuator spring that sustains a contact force on the closed contacts until said actuator spring is snapped overcenter by a movable actuator member operatively associated with said actuator spring, the improvement comprising the step of forming a fixed noncurrent carrying stop to be carried by said construction and to be engaged by said blade when said blade is moved by said actuator spring in the contact closing direction of said second contact with said first contact, and forming a biasing means to carry said first contact for being biased in said direction under the force of said actuator spring placing said blade against said stop and said second contact into contact with said first contact.

20. A method of making an electrical switch construction as set forth in claim 19 and including the step of forming said fixed non-current carrying stop from a non-conductive part of said construction.

21. A method of making an electrical switch construction as set forth in claim 19 and including the step of forming said biasing means from a leaf spring member that carries said first contact.

22. A method of making an electrical switch construction as set forth in claim 21 and including the step of forming said leaf spring member from a conductive member.

23. A method of making an electrical switch construction as set forth in claim 22 and including the steps of fixing one end of said leaf member to said construction while the other end thereof carries said first contact, forming said construction with a second non-current carrying stop, and causing said leaf member to have a natural bias that places said leaf against said second stop when said contacts are in an open condition thereof whereby said second contact flexes said leaf member away from said second stop when said blade is held against its respective stop by said actuator spring.

24. A method of making an electrical switch construction as set forth in claim 19 and including the steps of forming said actuator member with a lost motion means, and operatively interconnecting said actuator member to said actuator spring by said lost motion means.

* * * * *